US005689942A

United States Patent [19]

Suga

[11] Patent Number: 5,689,942

[45] Date of Patent: Nov. 25, 1997

[54] DRIVE MOTOR CONTROLLING APPARATUS FOR USE IN PACKAGING MACHINE

[75] Inventor: Yasutaka Suga, Ibaraki, Japan

[73] Assignee: Ibaraki Seiki Machinery Company, Ltd., Osaka-fu, Japan

[21] Appl. No.: 673,154

[22] Filed: Jun. 25, 1996

[51] Int. Cl.[6] ..... B65B 9/06; B65B 51/30

[52] U.S. Cl. ..... 53/550; 53/374.6; 53/389.4

[58] Field of Search ..... 53/550, 374.6, 53/389.4, 504, 51, 75, 551, 552, 389.5, 450

[56] References Cited

U.S. PATENT DOCUMENTS

| | | | |
|---|---|---|---|
| 4,712,357 | 12/1987 | Crawford et al. | 53/450 |
| 4,909,018 | 3/1990 | Yamamoto | 53/450 |
| 4,964,258 | 10/1990 | Seko et al. | 53/75 |
| 5,269,119 | 12/1993 | Tolson | 53/550 X |
| 5,271,210 | 12/1993 | Tolson | 53/550 |
| 5,329,745 | 7/1994 | Suga | 53/550 X |
| 5,337,542 | 8/1994 | Omori | 53/550 |
| 5,367,859 | 11/1994 | Suga | 53/374.6 X |
| 5,473,867 | 12/1995 | Suga | 53/550 X |
| 5,566,526 | 10/1996 | Suga | 53/550 X |

FOREIGN PATENT DOCUMENTS

| | | |
|---|---|---|
| 0230137 | 7/1987 | European Pat. Off. . |
| 0712782 | 5/1996 | European Pat. Off. . |
| 2266509 | 11/1993 | United Kingdom . |

*Primary Examiner*—Horace M. Culver

*Attorney, Agent, or Firm*—Barnes, Kisselle, Raisch, Choate, Whittemore & Hulbert, P.C.

[57] ABSTRACT

There is disclosed an apparatus for use in a bag forming/filling/sealing machine for controlling the operations of a film transportation motor, an article feeding motor, frame driving motor and a sealer opening-closing motor, wherein rotations of the film transportation motor and the article feeding motor are controlled based on the rotation of the frame driving motor. The rotation cycles of the film transportation motor, the article feeding motor and the frame driving motor are determined based on a reference pulse which is generated by a crystal oscillator and inputted to a central processing unit. When a value of the length of articles to be packaged is inputted to the central processing unit, the central processing unit specifies a cyclic variable speed of the frame driving motor based on data stored in a memory. The cyclic variable speed of the frame driving motor is properly controlled by comparing a feed-back pulse generated by an encoder with a reference pulse generated by the crystal oscillator, while rotational offsets of the film transportation motor and the article feeding motor are corrected based on a timing signal outputted from an electronic cam.

7 Claims, 5 Drawing Sheets

DRIVE MOTOR CONTROLLING APPARATUS FOR USE IN PACKAGING MACHINE

FIELD OF THE INVENTION

The present invention relates to apparatuses for controlling the rotational speeds of drive motors provided in various sections in a bag forming/filling/sealing machine.

BACKGROUND OF THE INVENTION

Bag forming/filling/sealing machines are designed to form a film web into a tube, then fill therein articles to be packaged, and cut and seal the film tube. More specifically, the bag forming/filling/sealing machines form an elongated film web into a longitudinally extending tube, then feed a succession of equidistantly spaced articles to be packaged into the film tube, and cross-seal the film tube between adjacent articles, thereby forming a bag containing an article packaged therein.

A packaging machine of this kind includes at least a motor for transporting a film, a motor for transporting articles to be packaged, and a motor for opening and closing a pair of sealers. In such a packaging machine, the rotational speeds of the respective motors are controlled to time the rotations of the respective motors by way of a microcomputer.

A packaging machine disclosed in U.S. Pat. No. 4,712,357, for example, controls the rotational speeds of a film transportation motor and a sealer opening-closing motor, based on the rotational speed of an article feeding motor which is kept constant. Another packaging machine disclosed in U.S. Pat. No. 4,909,018 controls the rotational speeds of an article feeding motor and a sealer opening-closing motor, based on the rotational speed of a film transportation motor.

These packaging machines are each designed such that the reference motor stops at a predetermined original stop position and the other two motors each stop in a preset phase relationship with respect to the reference motor when an operation stop signal is generated. In the former packaging machine, for example, the film transportation motor and sealer opening-closing motor are each adapted to stop in a preset phase relationship with respect to the article feeding motor when the article feeding motor stops at the original stop position in response to an operation stop signal. At this time, a pair of sealers are brought in contact with a film, resulting in fusion of the film due to heat applied thereto by the sealers.

In general, the stop position of a motor of this type is controlled by way of a computer. Therefore, it may be easy to control the stop positions of the respective motors so as to prevent the sealers from contacting the film. However, when the stop position of each sealer is changed due to a change in the length of articles to be packaged or a change in the interval between adjacent marks printed on the film, the contact of the sealers with the film is unavoidable.

To prevent the sealers from contacting the film, the rotational speeds of the film transportation motor and the article feeding motor may be controlled on the basis of the rotational speed of the sealer opening-closing motor. It is easy to employ the rotational speeds of the film transportation motor and article feeding motor as reference speeds because these motors are rotated at constant speeds. However, it has been difficult to employ the rotational speed of the sealer opening-closing motor as a reference speed because, unlike the other motors, the sealer opening-closing motor is rotated at a cyclic variable speed not at a constant speed.

To solve the aforesaid problem, it is an object of the present invention to control the rotational speeds of a film transportation motor and an article feeding motor on the basis of the rotational speed of a frame driving motor which synchronizes with the sealer opening-closing motor, thereby preventing sealers from contacting with a film when the operation of a packaging machine is stopped.

SUMMARY OF THE INVENTION

In order to solve the problem, the present invention provides an apparatus for use in a packaging machine for controlling the operations of a film transportation motor for transporting a continuous elongated film web through a tube forming means to form the film web into a continuous film tube, an article feeding motor for feeding articles to be packaged into the film tube at equidistant intervals from an entrance side of the tube forming means, a frame driving motor for reciprocating a frame in the same direction as the transportation of the film tube on an exit side of the tube forming means, said frame supporting a pair of sealers, and a sealer opening-closing motor for opening and closing the pair of sealers to cross-seal the film tube between adjacent articles to be packaged, said sealer opening-closing motor being mounted on the frame, rotational speeds of said motors being controlled to interrelate with each other, said apparatus comprising:

- a timing means for outputting a signal for every rotation of a shaft of the frame driving motor;
- a rotational angle division detecting means for outputting a multiplicity of pulse signals by subdividing an rotational angle of the shaft of the frame driving motor;
- a cycle determining means for determining a cycle of the frame driving motor based on a reference pulse generated from a reference pulse generator for generating micropulse pulses;
- a means for determining a rotation cycle of each of the four motors based on respective data outputted from the rotational angle division detecting means and the cycle determining means;
- a means for determining a cyclic variable speed of the frame driving motor based on numerical data on the size of articles to be packaged inputted from an input device, as comparing the pulse outputted from the rotational angle division detecting means with the reference pulse generated from the reference pulse generator; and
- a cycle offset correcting means for correcting cycle offsets of the film transportation motor and the article feeding motor by comparing pulses outputted from encoders respectively connected to the film transportation motor and the article feeding motor with the signal outputted from the timing means.

The reference pulse generator outputs, for example, 120 pulse signals per second. When the rotational speed determining means determines this 120 pulse signals as one cycle, the shafts of the four motors are driven to rotate for a specified angle per 120 pulse signals respectively.

The cyclic variable speed of the frame driving motor for one shaft rotation is determined with reference to data read out from a memory, when the numerical value of the length of the articles to be packaged is inputted from the input device, while comparing the pulse signal as to the rotation of the shaft of the frame driving motor outputted from the rotational angle division detecting means with the reference pulse signal generated by the reference pulse generator. The frame which supports the sealers is driven to reciprocate following the cyclic variable speed thus determined.

The cycle offsets of the respective film transportation motor and article feeding motor are corrected by comparing the signal outputted from the timing means provided to the shaft of the frame driving motor with the pulse signals outputted from the encoders each provided to the film transportation motor and the article feeding motor. This allows the film transportation motor and article feeding motor to be correctly driven on the basis of the operation of the frame driving motor. The rotation of the sealer opening-closing motor is synchronized with the rotation of the frame driving motor, thanks to the pulse signals as to the rotation of the shaft of the frame driving motor.

In the motor controlling apparatus of the present invention, as mentioned above, the rotation cycles of all the motors are determined on the basis of the pulse signal generated by the pulse generator, and the cycle offsets of the film transportation motor and article feeding motor with respect to the frame driving motor are detected by comparing the signal outputted from the timing means provided to the shaft of the frame driving motor with feed-back pulse signals output from the film transportation motor and article feeding motor, whereby the cycle offsets among the three motors are corrected. Further, the rotation of the sealer opening-closing motor is synchronized with the rotation of the frame driving motor, thanks to the pulse signals as to the rotation of the shaft of the frame driving motor. By thus controlling the cycle offsets, the film transportation motor and article feeding motor are driven on the basis of the operation of the frame driving motor and, therefore, the sealers can be stopped at the original stop positions, whereby the sealers can avoid staying in contact with the film while the operation of the packaging machine is stopped. When the length of articles to be packaged or the interval between adjacent marks printed on the film is changed, conveyor belts for transporting the film web and for feeding the articles to be packaged may be properly adjusted with the sealers stopped at the original stop positions. Thus, the film can be prevented from being melted with heat to be applied thereto by the sealers, even when the operation of the packaging machine is stopped.

The foregoing and other objects, features and advantages of the present invention will be apparent from the following detailed description of preferred embodiments of the invention with reference to the attached drawings.

DETAILED DESCRIPTION OF THE PREFERRED EMBODIMENTS

One preferred embodiment of the present invention will hereinafter be described with reference to FIGS. 1 to 6.

Figure 1:
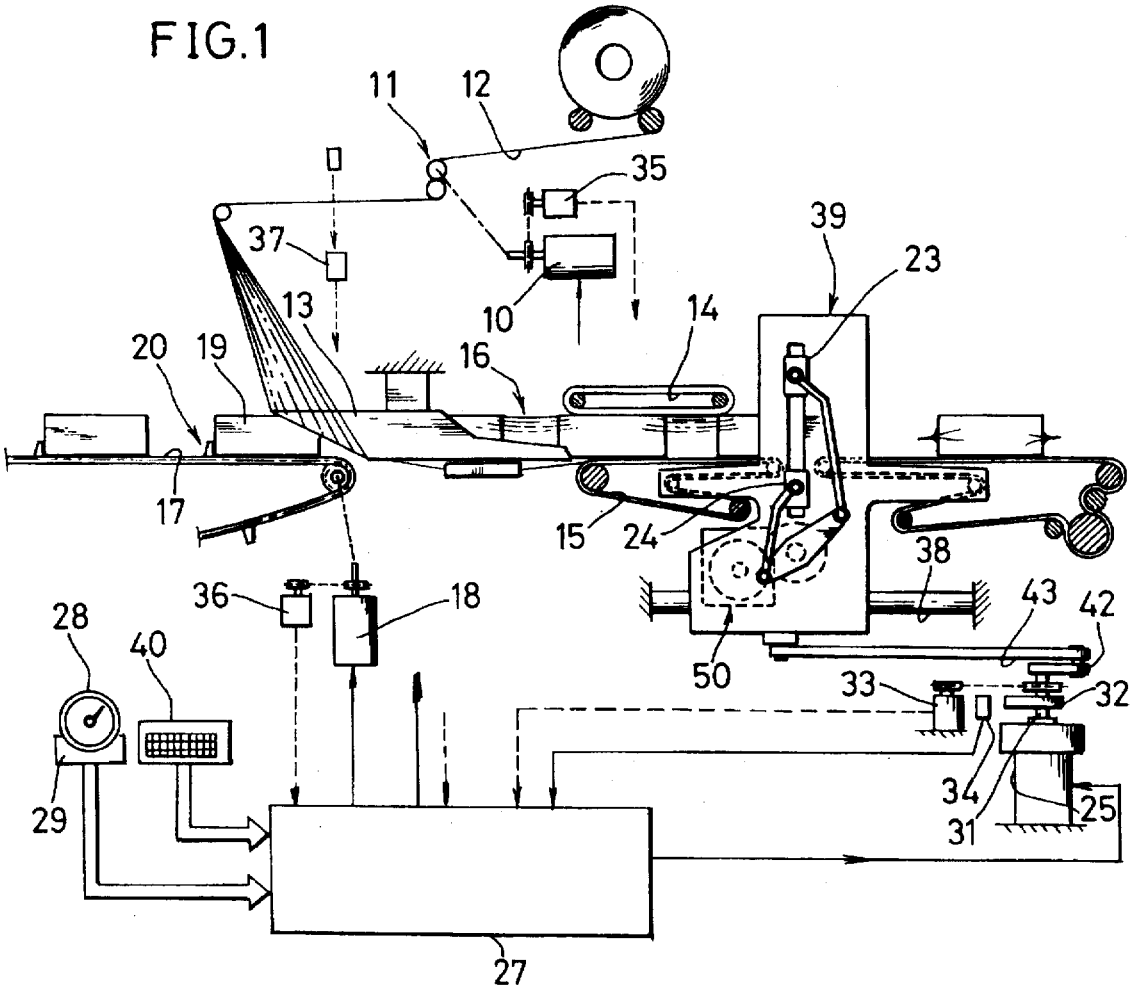
FIG. 1 is a side elevation of an apparatus of the present invention.

As shown in FIG. 1, feed rolls 11 rotated by a first motor 10 pays out and feeds an elongated film web 12 to tube forming means 13. The film web 12, which is tautened by the rotation of upper and lower belts 14 and 15 disposed downstream of the tube forming means 13, is formed into a film tube 16 when passing through the tube forming means 13.

A belt conveyor 17 disposed on the entrance side of the tube forming means 13 is continuously rotated by power of a second motor 18, whereby articles 19 to be packaged are successively pushed out by attachments 20 attached onto the outer periphery thereof, and equidistantly fed into the film tube 16.

A frame 39 is disposed downstream of the belt 14 to be slidable along a pair of guide rails 38. A crank arm 42 fixed to the shaft of a third motor 25 and the frame 39 are connected by means of a connecting rod 43, whereby the frame 39 is driven to reciprocate along the guide rails 38 when the crank arm is rotated by the driving force of the third motor 25.

Figure 6:
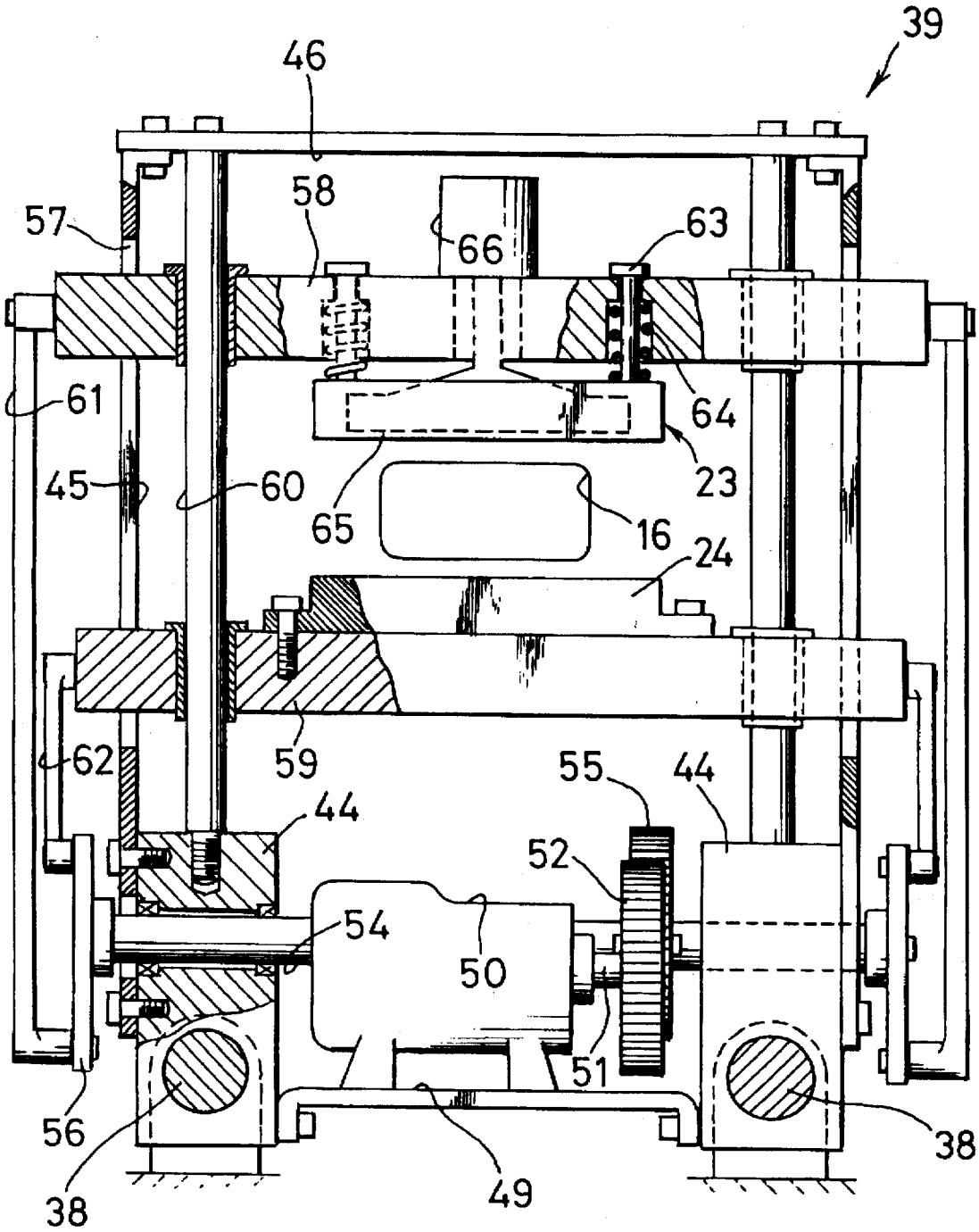
FIG. 6 is a front elevation of a sealer supporting frame.

Referring to FIG. 6, the frame 39 is formed in a portal-frame shape on the whole, and comprises a pair of blocks 44 supported to be slidable respectively along the pair of horizontal guide rails 38 and a pair of side boards 45 respectively fixed to the blocks 44 and connected at upper ends thereof with a top board 46. A fourth motor 50 is supported onto a mount 49 disposed between the blocks 44. A pinion 52 provided to a main shaft 51 of the fourth motor 50 is engaged with a gear 55 of a driven shaft 54 supported between the blocks 44. The pinion 52 is driven to rotate normally and reversely in the angle range of 30 degrees by the fourth motor 50, whereby bell cranks 56 provided at both ends of the driven shaft 54 are forced to repeat reverse rotation. Each of the side boards 45 is formed with a vertically extended slit guide 57 which is engaged with ends of a pair of upper and lower beams 58, 59 on both sides, whereby the beams 58, 59 are vertically movable along rod guides 60 erected on the blocks 44.

Both ends of the upper and lower beams 58, 59 are connected with both ends of each bell cranks 56 by means of large and small links 61, 62. As the bell cranks 56 rotate reversely, the distance between the upper and lower beams 58, 59 is narrowed and widened. An upper sealer 23 suspended from the upper beam 58 by means of spindles 63 is provided with protruding springs 64 inbetween with the upper beam 58 so that the springs 64 can work as cushioning against a force to push up the upper sealer 23 from below.

When the film tube is pressed by a lower sealer 24 fixed onto the upper surface of the lower beam 59 and the upper sealer 23, and flatly fused by a pipe heater embedded in the upper sealer 23 or a heating filament (not shown) provided on the bottom surface of the upper sealer 23, a cutter 65 provided inside of the upper sealer 23 is forced to descend under the pressure of a fluid cylinder 66 thereby cutting the sealed portion of the film tube 16. In FIG. 1, therefore, the frame 39 is driven to repeat reciprocation at a proper speed such that the upper and lower sealers 23, 24 can press the film tube 16 just inbetween adjacent articles to be packaged without fail.

Figure 2:
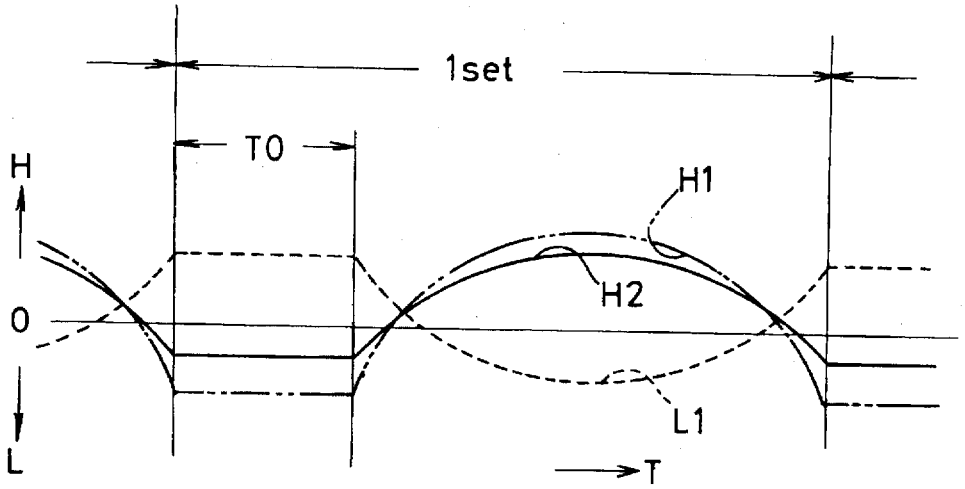
FIG. 2 is a graphical representation illustrating a cyclic variable speed of a sealer opening-closing motor.
Figure 3:
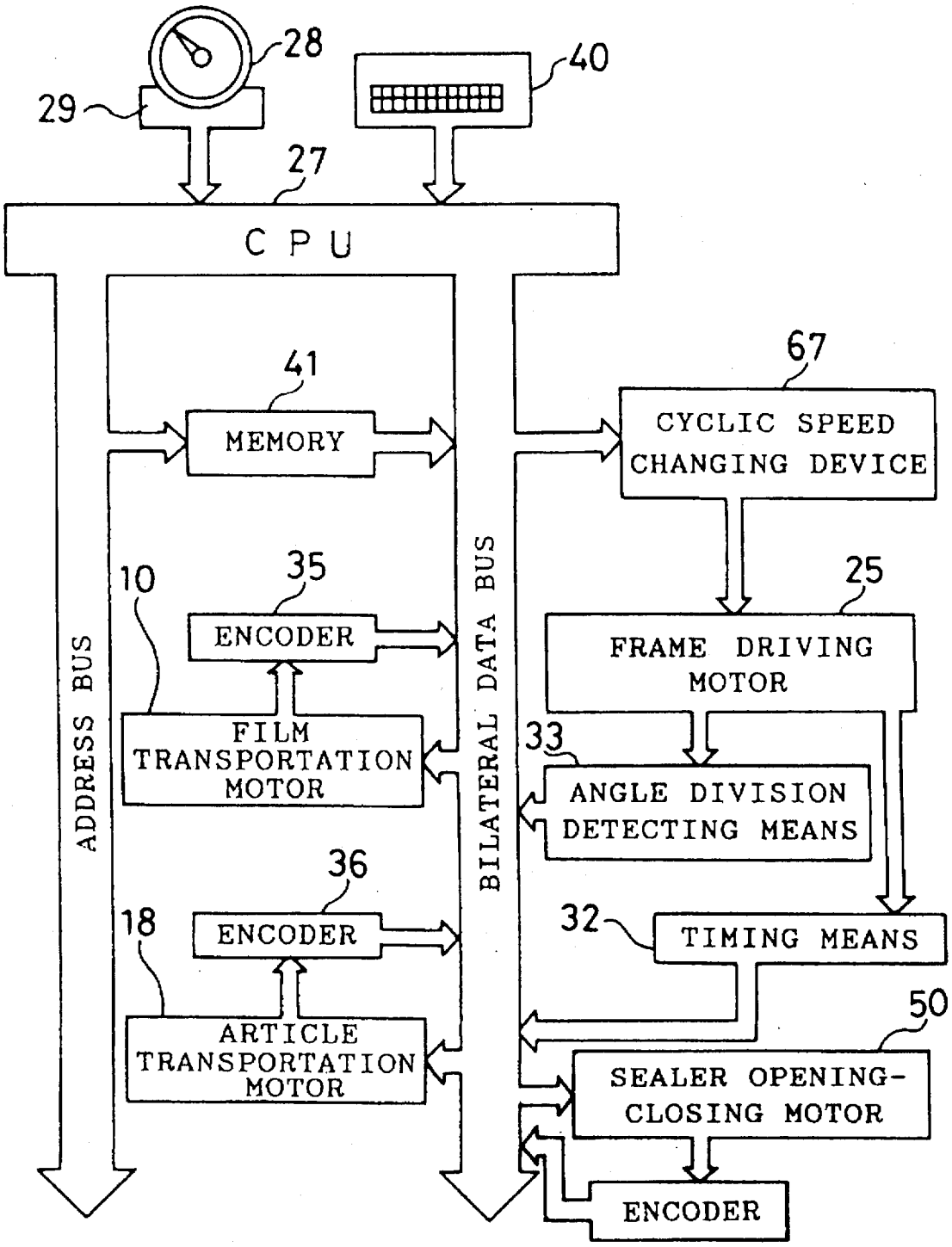
FIG. 3 is a diagram illustrating the construction of the apparatus.

A reference pulse generator 28 connected to a microprocessor or central processing unit 27 generates, for example, 120 electrical pulses per second. It is preferred in terms of accuracy that the reference pulse generator 28 comprises a crystal oscillator as a signal source. A cycle determining means 29 connected to the reference pulse generator 28 has a function to specify one cycle to be, for example, 120 pulses. As shown in FIG. 2, when one cycle (120 pulses) is specified to be one second, the frame 39 is driven to reciprocate once a second by power outputted through a decelerator 30 by the third motor 25.

The cycle determining means 29 generates a signal to give an instruction to the first motor 10 via the central processing unit 27, thereby controlling the film transportation in order that marks printed on the film 12 move ahead by one pitch per second. The marks printed on the film are detected by a sensor 37. The cycle determining means 29 also gives an instruction to the second motor 18 via the central processing unit 27 to control the transportation of the articles in order that the attachments 20 provided on the belt conveyor 17 move ahead by one pitch per second. Feed-back signals outputted from encoders 35 and 36 respectively attached to shafts of the first and second motors 10 and 18 are used to control the rotational speeds of the first and second motors 10 and 18.

A shaft 31 of the third motor 25 is provided with a electric cam 32 and an encoder 33. The electronic cam contacts a switch 34 every time the shaft 31 rotates once, and the rotation cycle of the shaft 31 is inputted to the central processing unit 27. A pulse signal outputted from the third encoder 33 indicative of a rotational angle division of the shaft 31 is fed back to the central processing unit 27, which controls the rotation of the third motor 25 in order that the shaft 31 is rotated exactly once a second.

Figure 4:
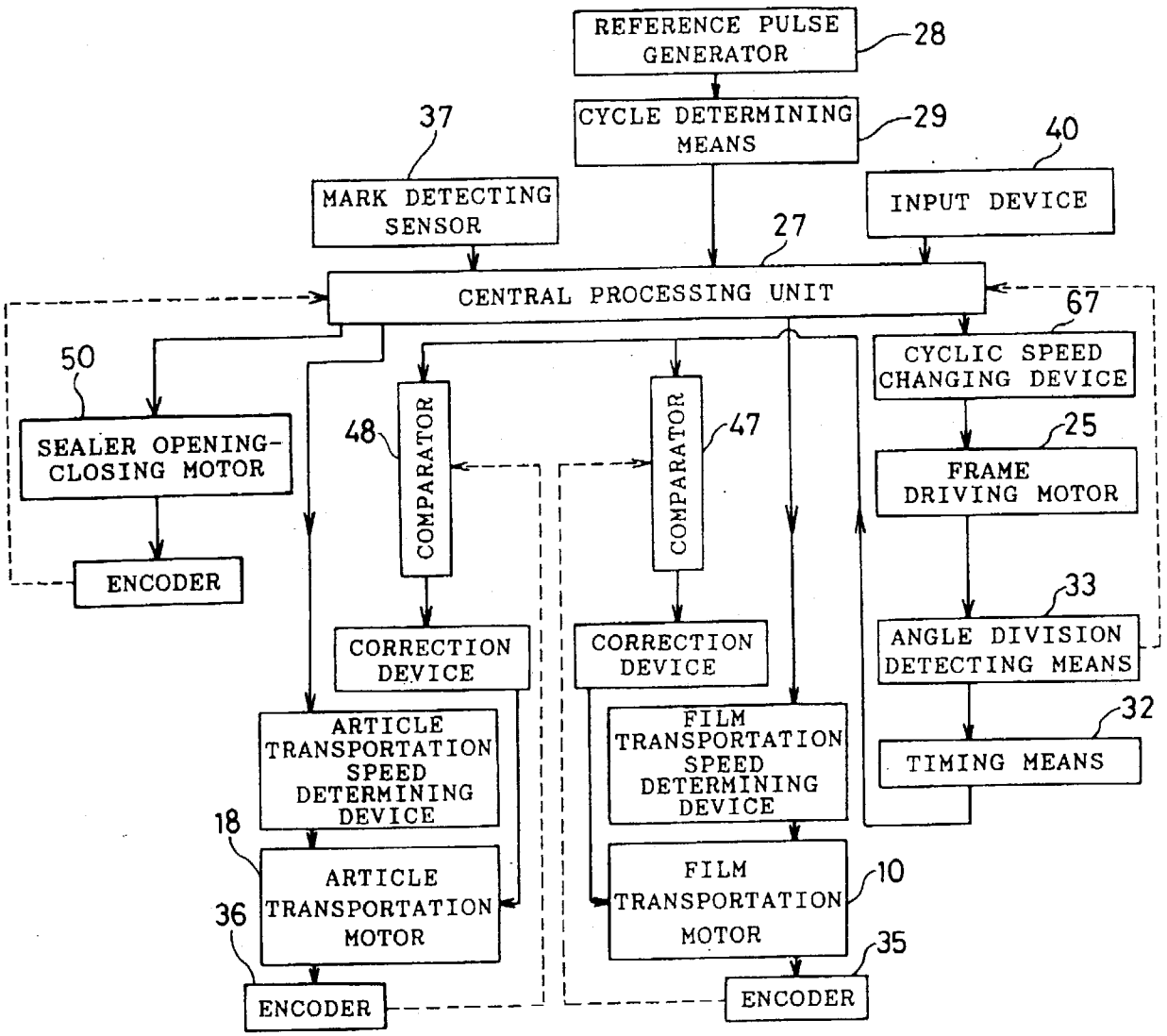
FIG. 4 is a block diagram of the apparatus.

When a value of a length of the articles to be packaged is inputted to the central processing unit 27 from an input device 40 as shown in FIGS. 1 and 4, specific information corresponding to the inputted value is read out of a memory 41. The read out information includes data for specifying the transportation speed of the film 12 in accordance with the length of the articles 19 and data for specifying the cyclic variable speed of the sealers 23 and 24. Therefore, as in FIG. 3, the rotational speeds of the first and second motors 10 and 18 are variably set in accordance with the length of the articles 19, while the cyclic speed of the third motor is varied by a cyclic speed changing device 67.

Figure 5:
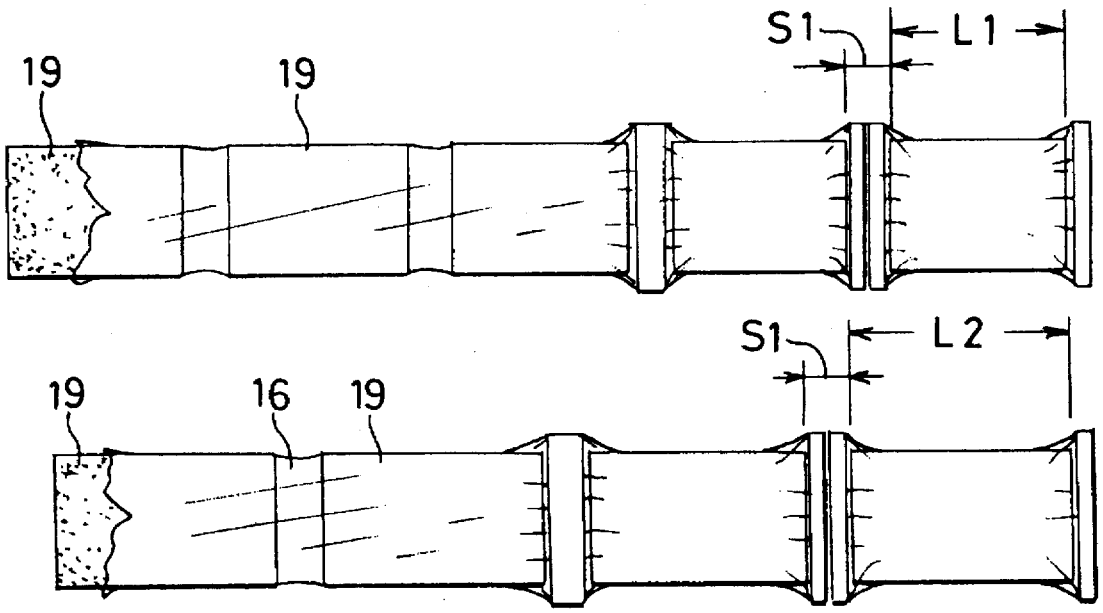
FIG. 5 is a diagram for explaining a film transportation speed which is adjusted in accordance with the length of articles to be packaged.

In order to keep a sealing width S1 between adjacent articles 19 as shown in FIG. 5 to be constantly uniform without varying the opening-and-closing cycle of the sealers 23, 24 which is set at one second, when the articles have a length L2 which is longer than a shorter length L1, the transportation speed of the film tube 16 needs be increased for the amount of difference in length between L1 and L2. Further in FIG. 2, a period TO during which the sealers 23 and 24 are brought in contact with the film within one cycle (one second) is kept constant, and the rotational speed of the sealers while the sealers are brought away from the film is variously changed by being increased to be higher H or decreasing to be lower L, thus to be various speeds H1, H2 or L1, in accordance with the transportation speed of the film and others, whereby the rotation cycle of the sealers is kept at one second or 120 pulses as generated by the reference pulse generator 28. Where the cyclic variable speed of the sealers is as indicated by a dotted line, for example, when the speed of the sealers is high while the sealers are in contact with the film, the speed of the sealers while the sealer are away from the film, L1, is lowered. Thus, the rotation cycle is always kept to be one second on the whole.

Referring to FIG. 4, the rotational angle of the shaft of the third motor 25 is detected by a rotational angle division detecting means like an encoder, and the rotation cycle of the third motor 25 is controlled exactly to be one second or 120 pulses as generated by the reference pulse generator 28 by feeding back the detected data to the central processing unit 27. A timing signal outputted once a second from the timing means or electronic cam 32 is compared with pulse signals outputted from the first encoder 35 and the second encoder 36 by means of comparators 47 and 48. As a result, cycle offsets of the first motor 10 and the second motor 18 are corrected with reference to the offsets between these signals compared.

Moreover, the angle division detecting means or third encoder 33 can also play a role of the timing means or electronic cam 32.

While only a certain presently preferred embodiment has been described in detail, certain changes and modifications can be made in the embodiment without departing from the spirit and scope of the present invention as defined by the following claims.

What is claimed is:

1. An apparatus for use in a packaging machine for controlling the operations of a film transportation motor for transporting a continuous elongated film web through a tube forming means to form the film web into a continuous film tube, an article feeding motor for feeding articles to be packaged into the film tube at equidistant intervals from an entrance side of the tube forming means, a frame driving motor for reciprocating a frame in the same direction as the transportation of the film tube on an exit side of the tube forming means, said frame supporting a pair of sealers, and a sealer opening-closing motor for opening and closing the pair of sealers to cross seal the film tube between adjacent articles to be packaged, said sealer opening-closing motor being mounted on the frame, rotational speeds of said motors being controlled to interrelate with each other, said apparatus comprising:

a timing means for outputting a signal for every rotation of a shaft of the frame driving motor;

a rotational angle division detecting means for outputting a multiplicity of pulse signals by subdividing an rotational angle of the shaft of the frame driving motor;

a cycle determining means for determining a cycle of the frame driving motor based on a reference pulse generated by a reference pulse generator for generating micropulse pulses;

a means for determining a rotation cycle of each of the four motors based on respective data outputted from the rotational angle division detecting means and the cycle determining means;

a means for determining a cyclic variable speed of the frame driving motor based on numerical data on the size of articles to be packaged inputted from an input device, by comparing the pulse outputted from the rotational angle division detecting means with the reference pulse generated by the reference pulse generator; and a cycle offset correcting means for correcting cycle offsets of the film transportation motor and the article feeding motor by comparing pulses outputted from encoders respectively connected to the film transportation motor and the article feeding motor with the signal outputted from the timing means.

2. An apparatus as set forth in claim 1, wherein said timing means is an electronic cam attached to the shaft of the sealer opening-closing motor.

3. An apparatus as set forth in claim 1, wherein said rotational angle division detecting means also plays a role of the timing means concurrently.

4. An apparatus as set forth in claims 1 and 2, wherein said reference pulse generator comprises a crystal oscillator.

5. An apparatus as set forth in claim 1, wherein said sealer opening-closing motor for opening and closing the sealers to cross seal the film tube is capable of varying the duration of pressing the tube film with the sealers in accordance with instructions received from the input device according to the kind of the tube film.

6. An apparatus as set forth in claim 1, wherein said sealer opening-closing motor for opening and closing the sealers to cross seal the film tube is capable of adjusting the force of pressing the tube film with the sealers in accordance with instructions received from the input device according to the kind of the tube film.

7. An apparatus as set forth in claim 1, wherein said sealer opening-closing motor for opening and closing the sealers to cross seal the film tube is capable of adjusting the distance between the pair of upper and lower sealers when opened in accordance with instructions received from the input. device according to the size of articles to be packaged.

* * * * *